United States Patent [19]

Watanabe

[11] Patent Number: 4,464,210

[45] Date of Patent: Aug. 7, 1984

[54] NI-CR-W ALLOY HAVING IMPROVED HIGH TEMPERATURE FATIGUE STRENGTH AND METHOD OF PRODUCING THE SAME

[75] Inventor: Rikizo Watanabe, Yasugi, Japan

[73] Assignee: Hitachi Metals, Ltd., Tokyo, Japan

[21] Appl. No.: 389,497

[22] Filed: Jun. 17, 1982

[30] Foreign Application Priority Data

Jun. 30, 1981 [JP] Japan ..... 56-100709

[51] Int. Cl.[3] ..... C22F 1/10; C22C 19/05

[52] U.S. Cl. ..... 148/162; 148/410

[58] Field of Search ..... 148/32, 32.5, 162; 75/171

[56] References Cited

U.S. PATENT DOCUMENTS 4,006,015 2/1977 Watanabe et al. ..... 75/171

*Primary Examiner*—R. Dean

*Attorney, Agent, or Firm*—Antonelli, Terry & Wands

[57] ABSTRACT

An Ni-Cr-W alloy having improved high temperature fatigue strength and superior creep rupture strength. The alloy contains, by weight, less than 0.1% of C, 21 to 26% of Cr, 16 to 21% of W and more than 50% of Ni. The alloy has a structure in which the austenite has a mean grain size larger than 100 μm and in which the primary solid solution of W of body centered cubic crystal is precipitated preferentially in the austentite grain boundary. Disclosed also is a method of producing this alloy.

8 Claims, 3 Drawing Figures

(x1000)

NI-CR-W ALLOY HAVING IMPROVED HIGH TEMPERATURE FATIGUE STRENGTH AND METHOD OF PRODUCING THE SAME

BACKGROUND OF THE INVENTION

The present invention relates to an Ni-Cr-W heat-resistant alloy which has a high creep rupture strength and superior high temperature fatigue strength and which exhibits a good workability and, hence, can easily be worked into rods, wires, plates tubes and so forth. The invention relates also to a method of producing the above-mentioned Ni-Cr-W alloy.

The present inventors have already developed an alloy containing, as the main components, 23%Cr-18%W-Ni and exhibiting a high workability, as well as a high creep rupture strength. This alloy is disclosed in Japanese Patent Publication No. 33212/1979. Hitherto, a mere solution heat treatment at 1250° to 1350° C. has been adopted as a method of heat-treating this alloy. The heat-treated alloy has a structure which essentially consists of simple austenite grains of grain size larger than 100 μm, except small amount of undissolved precipitates.

It has been proved that the alloy having such structure has a disadvantage in that its high temperature fatigue strength is relatively low, although its creep rupture strength is sufficiently high. Besides the creep rupture strength, the high temperature fatigue strength is an important property which rules and restricts the design of high-temperature equipments such as heat exchangers. As a matter of fact, however, the high temperature fatigue strength is incompatible with the creep rupture strength from a metallurgical point of view. Namely, if one of the high temperature fatigue strength and creep rupture strength is increased preferentially, the other is decreased undesirably. For instance, in the case of the 23%Cr-18%W-Ni alloy disclosed in Japanese Patent Publication No. 33212/1979 mentioned before, the grain is refined to provide an improved high-temperature fatigue strength if the solution heat treatment temperature is lowered to below 1150° C., but this is accompanied by a reduction in creep rupture strength which is one of the important properties of this alloy.

SUMMARY OF THE INVENTION

Accordingly, it is a primary object of the invention to provide an Ni-Cr-W alloy in which the high-temperature fatigue strength is essentially improved without being accompanied by reduction in the creep rupture strength, as well as a method of producing such an alloy. To this end, according to one aspect of the invention, there is provided an Ni-Cr-W alloy having improved high-temperature fatigue strength, the alloy containing, by weight, less than 0.1% of C, 21 to 26% of Cr, 16 to 21% of W and more than 50% of Ni and having a structure in which austenite has a mean grain size larger than 100 μm and primary solid solution of W of body centered cubic crystal is precipitated preferentially in the austenite grain boundary.

According to another aspect of the invention, there is provided a method of producing the alloy mentioned above, the method comprises the steps of: heating an alloy containing above-mentioned elements at a temperature higher than 1280° C. for at least 0.1 hour to dissolve almost all precipitates into austenite phase and to coarsen the austenite grains to larger than 100 μm in mean grain size; cooling the alloy down to a temperature below 500° C. at a high cooling rate sufficient to avoid formation of any precipites during cooling; and reheating the alloy for at least 0.5 hour at a temperature 30° to 200° C. lower than the first-mentioned heating temperature, thereby to precipitate the primary solid solution of W of body centered cubic crystal preferentially in the austenite grain boundary.

The above and other objects, features and advantages of the invention will become clear from the following description of the preferred embodiments taken in conjunction with the accompanying drawings.

DESCRIPTION OF THE PREFERRED EMBODIMENTS

Figure 1:
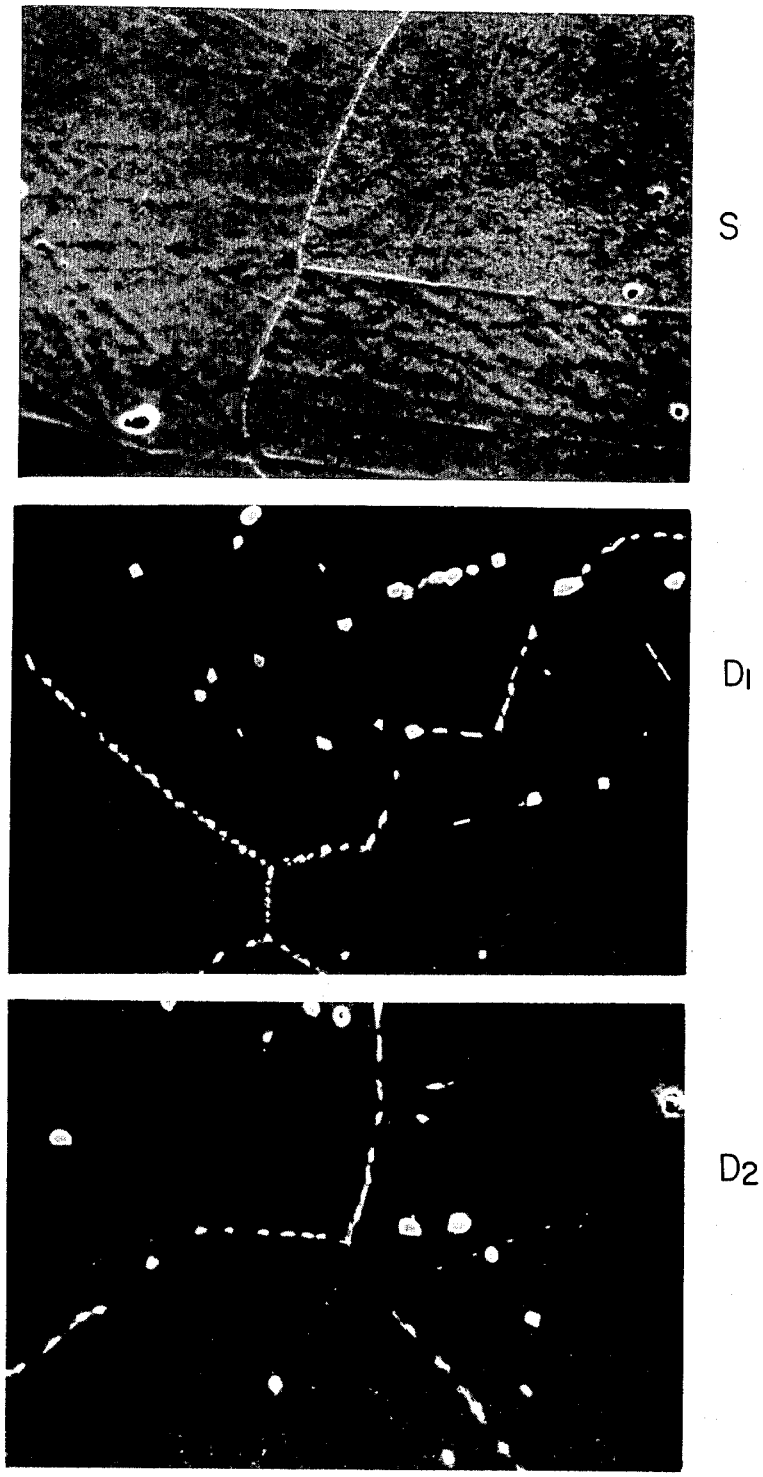
FIG. 1 shows microscopic photographs of the microstructures ($D_1$, $D_2$) of a rod material treated in accordance with the method of the invention in comparison with that (S) of a rod material treated in accordance with a conventional method.

In the alloy of the invention, C is essential because it causes a precipitation of $M_{23}C_6$ type carbide to increase the creep rupture strength of the alloy. However, C content exceeding 0.1% undesirably promotes the production of $M_6C$ type carbide having small solid solubility thereby making the grain-coarsening difficult and, at the same time, hindering the preferential grain boundary precipitation of the primary solid solution of W. Thus, the C content is limited to less than 0.1%.

The Cr offers various advantages such as oxidation resistance, strengthening due to precipitation of $M_{23}C_6$ type carbide, solid solution hardening, promotion of production of primary solid solution of W and so forth and, hence, the Cr content must be at least 21%. A Cr content less than 21% is not preferred because the carbide takes the form of $M_6C$ type to reduce the creep rupture strength. On the other hand, a Cr content in excess of 26% causes an excessively heavy production of primary solid solution of W and unnecessarily raises the solution heat treatment temperature, and further deteriorates the forgeability. For these reasons, according to the invention, the Cr content is limited to fall within the range of between 21 and 26%.

The W is an essential element for attaining various advantages such as solid solution hardening, grain boundary strengthening due to preferential grain boundary precipitation of primary solid solution of W, precipitation strengthening due to primary solid solution of W precipitated within grains during use, and so forth. For attaining these advantageous features, the W content should be at least 16%. However, a W content exceeding 21% excessively increases the primary solid solution of W to undesirably impede the coarsening of the austenite grain resulting in an unnecessarily high solution heat treatment temperature. For these reasons, the W content is limited to range between 16 and 21% in the alloy of the invention.

The Ni is an important element constituting the austenite matrix. In order that the precipitate of W takes the form of an effective primary solid solution of W but not noxious intermetallic compounds, the Ni content should be at least 50%. The Ni content, therefore, is limited to be at least 50%, in the alloy of the invention.

In the alloy of the invention, it is possible to add, besides the four elements mentioned above, the following elements solely or in combination: less than 1% of Ti; less than 1% of Nb; less than 0.1% of Ca; less than 0.1% of Mg; less than 0.1% of B; less than 0.5% of Zr; less than 0.5% of Y; less than 0.5% of rare earth elements; less than 1% of Hf; less than 1.5% of Al; less than 2% of Mn; less than 1% of Si; less than 6% of Co; less than 3% of Mo and less than 6% of Fe. These additional elements causes specific advantages, as well as disadvantages, so that these elements have to be suitably selected in accordance with the purposes and conditions of use. For instance, Ti and Nb in one hand strenghten the alloy through promotion of precipitation of carbides during the use but, on the other hand, undesirably deteriorate the oxidation resistance. Also, Ca, Mg, B and Hf cause a grain boundary strenghthening but degrades the weldability. A certain improvement in oxidation resistance is achieved by addition of Y, rare earth elements, Al, Mn and Si. However, on the other hand, Y and rare earth elements impede the hot workability, while Al and Si promote internal oxidation undesirably. Also, creep rupture strength is deteriorated by the addition of Mn. The Co and Mo, which are effective in increasing the creep rupture strength, deteriorate the oxidation resistance. The addition of Co is not preferred when the alloy is used as a structural material for nuclear power system, because the Co exhibits a large tendency to carry induced radioactivity. The Fe degrades the creep rupture strength although it improves the hot-workability.

The alloy of the invention usually contains 0.02 to 0.07% of C, 22 to 24% of Cr, 17.5 to 19.5% of W, 0.3 to 0.6% of Ti, 0.01 to 0.05% of Zr and the balance Ni.

In the alloy of the invention, for maintaining a sufficient creep rupture strength, it is necessary that the mean grain size of austenite is larger than 100 μm. Any mean grain size of austenite finer than 100 μm inconveniently increases the tendency to cause grain boundary sliding and diffusion creep thereby deteriorating the creep rupture strength. Preferred mean grain size is between 200 and 500 μm.

The most distinctive characteristic of the alloy of invention over the conventional alloy resides in that the structure has primary solid solution of W precipitated preferentially in the grain boundary of austenite. The present inventors have found that the primary solid solution of W precipitated in the grain boundary remarkably strengthens the grain boundary against cyclic strain at high temperature, so that the high temperature fatigue strength is improved remarkably. In addition, the primary solid solution of W precipitated in the grain boundary has as secondary effect to improve the creep rupture ductility.

In the method of producing the alloy of the invention, the first solution heat treatment is conducted in order to dissolve almost all precipitates into austenite phase and to coarsen the austenite grains to larger than 100 μm in mean grain size. To this end, the alloy of the invention has to be heated for at least 0.1 hour at a high temperature above 1280° C. Usually, this aim is achieved by heating the alloy for 1 hour at 1300° C. The cooling of the alloy after the solution heat treatment is made down to a temperature below 500° C. at a high cooling rate sufficient to avoid substantial precipitation during cooling. This cooling is generally achieveable by air cooling but oil quenching or water quenching are necessary when the size of the heat-treated material is large. Since almost no precipitation takes place at a temperature below 500° C., it is not necessary to pay specific attention to the cooling rate after the alloy is cooled below 500° C.

After the supersaturated austenite structure of mean grain size exceeding 100 μm is obtained by solution heat treatment, when the alloy is reheated to a temperature slightly lower than the solution heat treatment temperature, the primary solid solution of W is precipitated preferentially in the austenite grain boundary from the supersaturated austenite. In order to obtain a sufficient grain boundary precipitation, the temperature of heat treatment for causing grain boundary precipitation, i.e. the reheating temperature, should be at least 30° C. lower than the solution heat treatment temperature. However, if the reheating is conducted at a temperature which is more than 200° C. lower than the solution heat treatment temperature, a large amount of the primary solid solution of W is precipitated also within the grains and further the precipitation of $M_{23}C_6$ type carbide becomes liable to occur. For these reasons, according to the invention, the temperature of heat treatment for causing grain boundary precipitation is restricted to a temperature which is 30° to 200° C. lower than the solid solution heat treatment temperature. Usually, when the solution heat treatment is conducted at 1300° C., it is preferred that the treatment for causing grain boundary precipitation is effected at 1250° to 1200° C., which is 50° to 100° C. lower than the solution heat treatment temperature. The time length of the treatment for causing grain boundary precipitation should be at least 0.5 hour. If the time length is shorter than 0.5 hour, it is not possible to obtain sufficient grain boundary precipitation of the primary solid solution of W. However, the time length of the treatment for causing grain boundary precipitation is not required to be so long, because the temperature of the treatment for causing grain boundary precipitation is as high as 1080° C. at the lowest. Usually, a satisfactory result is obtained by the time length of one hour when the treatment for causing grain boundary precipitation is conducted at a temperature which is 30° to 100° C. lower than the solution heat treatment temperature and by the time length of about two hours when the treatment is conducted at a temperature which is 100° to 200° C. lower than the solution heat treatment temperature.

The invention will be more fully understood from the following description of Examples.

EXAMPLE 1

The following three kinds of heat treatments (S, $D_1$ and $D_2$) were conducted with a rod material of 21 mm in diameter, made of an alloy consisting essentially of 0.057% of C, 23.6% of Cr, 18.1% of W, 0.53% of Ti, 0.02% of Zr and the balance Ni.

S: 1300° C.×1 hour, water quenching $D_1$: 1300° C.×1 hour, water quenching+1250° C.×1 hour, water quenching $D_2$: 1300° C.×1 hour, water quenching+1200° C.×1 hour, water quenching The treatment S represents the conventional heat treating method while the treatments $D_1$ and $D_2$ embody the heat treating method in accordance with the invention. In each case, the mean grain size is 150 to 250 μm. As shown in FIG. 1, almost no precipitates appear in the grain boundary in the material treated by the treatment S, while it will be seen that by the treatments $D_1$ and $D_2$ it is possible to obtain a structure in which the primary solid solution of W is precipitated preferentially in the grain boundary.

EXAMPLE 2

The heat treatments same as the treatments S and $D_1$ is Example 1 were applied to the same material as in Example 1, and the treated materials were subjected to a strain controlled type high temperature fatigue test under the following condition: strain rate 0.1%/sec; test temperature 800° C., strain range ±0.25%, ±0.35%, ±0.5% and ±1.0% (total strain range being 0.5%, 0.7%, 1% and 2%, respectively); no holding time. Table 1 shows the fatigue life.

TABLE 1

| heat treatment | (Cycle) total strain range 0.5% | 0.7% | 1% | 2% |
|---|---|---|---|---|
| S | 716 | 305 | 133 | 45 |
| $D_1$ | 3592 | 1234 | 405 | 98 |

From Table 1, it will be seen that the material treated by the treatment $D_1$ in accordance with the invention exhibits a high temperature fatigue life which is 2 to 5 times as long as that of the material treated by the conventional treatment S.

The fracture face of the test piece after the fatigue test was observed. It was confirmed that, while in the material treated by the treatment S the fatigue crack is propagated through the grain boundary, in the material treated by the treatment $D_1$ in accordance with the invention the fatigue crack is propagated mainly through the grains. Thus, it was confirmed that the grain boundary in the material treated by the treatment $D_1$ is remarkably strengthened against propagation of the crack as compared with the material treated by the conventional treatment S.

EXAMPLE 3

The following heat treatments were conducted on a tube material of 60 mm dia. and 8 mm thick made of an alloy consisting essentially of 0.056% of C, 23.6% of Cr, 18.4% of W, 0.54% of Ti, 0.03% of Zr and the balance Ni.

Figure 2:
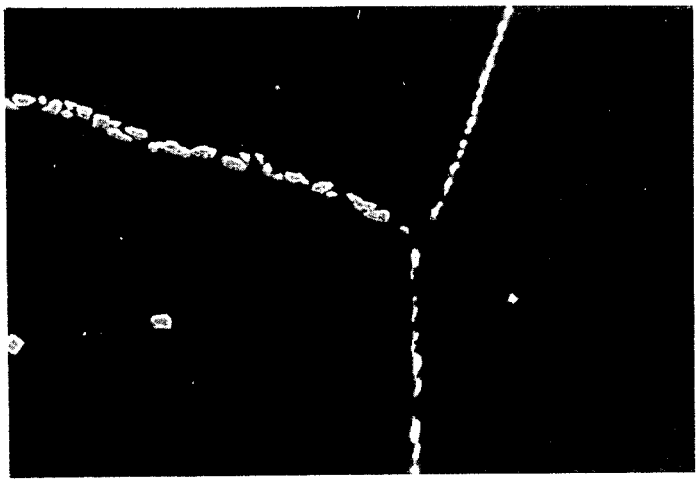
FIG. 2 shows a microscopic photograph of a microstructure of a tube material treated in accordance with the method of the invention.

S: 1300° C.×1 hour, water quenching $D_1$: 1300° C.×1 hour, water quenching+1250° C.×1 hour, water quenching The treatment S represents the conventional heat treating method while $D_1$ is a heat treating method of the invention. The microstructures of the treated materials were observed, and as a result it was confirmed that the mean grain size was about 300 to 500 μm in each case. However, while the material treated by the treatment S had substantially no precipitation in the grain boundary, the material treated by the treatment $D_1$ had, as shown in FIG. 2, a structure in which primary solid solution of W was precipitated preferentially in the grain boundary.

EXAMPLE 4

Figure 3:
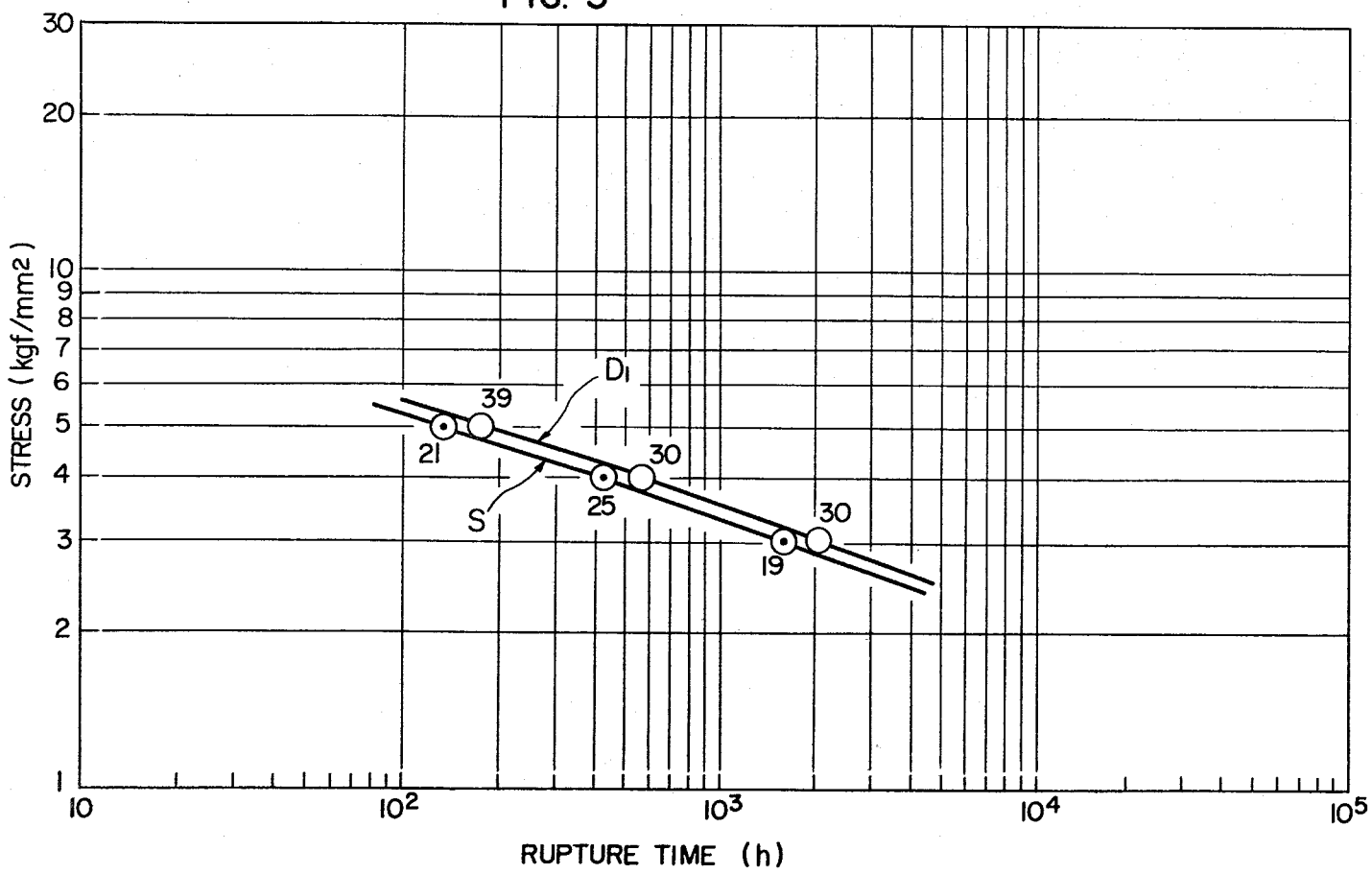
FIG. 3 is a chart showing the result of a creep rupture test conducted with tube materials.

A creep rupture test was conducted at 1000° C. with the materials treated by the treatments S and $D_1$ in Example 3, the result of which is shown in FIG. 3. The numerals appearing in FIG. 3 represent the creep rupture elongation (%). As will be seen from FIG. 3, the material treated by the treatment $D_1$ of the invention exhibits a creep rupture strength equivalent to or greater than that of the material treated by the conventional treatment S, and much higher creep rupture elongation than the same.

As has been described, according to the invention, it is possible to obtain a heat-resistant alloy having a good workability, high creep rupture strength and superior high temperature fatigue strength. The heat-resistant alloy of the invention can easily be worked into plates or tubes, so that the superior properties of this alloy are fully utilized when the alloy is used as the material of various parts which are used at a high temperature around 1000° C. or higher. Particularly, since the alloy of the invention does not necessarily contain Co as an alloying element, the alloy of the invention can suitably be used as the material of intermediate heat exchanger of high temperature gas cooled reactor which suffers a serious problem of induced radioactivity. Furthermore, the alloy of the invention is superior to the conventional alloys also as the material of combustion chamber of gas turbines.

What is claimed is:

1. An Ni-Cr-W alloy having an improved high temperature fatigue strength, consisting essentially of, by weight, less than 0.1% of C, 21 to 26% of Cr, 16 to 21% of W and more than 50% of Ni, and having a structure in which the means grain size of austenite is larger than 100 μm and the primary solid solution of W of body-centered cubic crystal is precipitated preferentially in the austenite grain boundary.

2. An Ni-Cr-W alloy having an improved high temperature fatigue strength consisting essentially of, by weight, 0.02 to 0.07% of C, 22 to 24% of Cr, 17.5 to 19.5% of W, 0.3 to 0.6% of Ti, 0.01 to 0.05% of Zr and the balance essentially Ni except inevitable impurities and having a structure in which the mean grain size of austenite is larger than 100 μm and the primary solid solution of W of body-centered cubic crystal is precipitated preferentially in the austenite grain boundary.

3. A method of producing an Ni-Cr-W alloy having an improved high temperature fatigue strength comprising the steps of: heating, for longer than 0.1 hour at a first temperature higher than 1280° C., an alloy consisting essentially of, by weight, less than 0.1% of C, 21 to 26% of Cr, 16 to 21% of W and more than 50% of Ni, to dissolve almost all precipitates into the austenite phase and to coarsen the austenite grains to larger than 100 μm in mean grain size; cooling the alloy to a temperature below 500° C. at a high cooling rate sufficient to avoid any substantial precipitation during the cooling; and reheating said alloy to a second temperature which is 30° to 200° C. lower than the first heating temperature for longer than 0.5 hour, thereby causing a preferential precipitation of primary solid solution of W of body-centered cubic crystal in the austenite grain boundary.

4. A method of producing an Ni-Cr-W alloy according to claim 3, wherein said alloy is heated at the first temperature for one hour at 1300° C. and at the second temperature of 1250°-1200° C. for one to two hours; said high cooling rate being effected by water quenching the alloy.

5. A method of producing an Ni-Cr-W alloy having an improved high temperature fatigue strength comprising the steps of: heating, for longer than 0.1 hour at a first temperature higher than 1280° C., an alloy consisting essentially of, by weight, 0.02 to 0.07% of C, 22 to 24% of Cr, 17.5 to 19.5% of W, 0.3 to 0.6% of Ti, 0.01 to 0.05% to Zr and the balance essentially Ni except inevitable impurities, to dissolve almost all precipitates into the austenite phase and to coarsen the austenite grains to larger than 100 μm in mean grain size; cooling the alloy to a temperature below 500° C. at a high cooling rate sufficient to avoid any substantial precipitation during the cooling; and reheating said alloy to a second temperature which is 30° to 200° C. lower than the first heating temperature for longer than 0.5 hour, thereby causing a preferential precipitation of primary solid solution of W of body-centered cubic crystal in the austenite grain boundary.

6. A method of producing an Ni-Cr-W alloy according to claim 5, wherein said alloy is heated at the first temperature for one hour at 1300° C. and at the second temperature of 1250°–1200° C. for one to two hours; said high cooling rate being effected by water quenching the alloy.

7. An Ni-Cr-W alloy having an improved high temperature fatigue strength, said alloy consisting essentially of, by weight, less than 0.1% of C, 21 to 26% of Cr, 16 to 21% of W, one or more than two of less than 1% of Ti, less than 1% of Nb, less than 0.1% of Ca, less than 0.1% of Mg, less than 0.1% of B, less than 0.5% of Zr, less than 0.5% of Y, less than 0.5% of rare earth elements, less than 1% of Hf, less than 0.5% of Al, less than 2% of Mn, less than 1% of Si, less than 6% of Fe, and more than 50% of Ni, and having a structure in which the mean grain size of austenite is larger than 100 μm and the primary solid solution of W of body-centered cubic crystal is precipitated preferentially in the austenite grain boundary.

8. A method of producing an Ni-Cr-W alloy having an improved high temperature fatique strength comprising the steps of: heating, for longer than 0.1 hour at a first temperature higher than 1,280° C., an alloy consisting essentially of, by weight, less than 0.1% of C, 21 to 26% of Cr, 16 to 21% of W, one or more than two of less than 1% of Ti, less than 1% of Nb, less than 0.1% of Ca, less than 0.1% of Mg, less than 0.1% of B, less than 0.5% of Zr, less than 0.5% of Y, less than 0.5% of rare earth elements, less than 1% of Hf, less than 1.5% of Al, less than 2% of Mn, less than 1% of Si, less than 6% of Co, less than 3% of Mo and less than 6% of Fe, and more than 50% of Ni, to dissolve almost all precipitates into the austenite phase and to coarsen the austenite grains to larger than 100 μm in mean grain size; cooling the alloy to a temperature below 500° C. at a high cooling rate sufficient to avoid any substantial precipitation during the cooling; and reheating said alloy to a second temperature which 30° to 200° C. lower than the first heating temperature for longer than 0.5 hour, thereby causing a preferential precipitation of primary solid solution of W of body-centered cubic crystal in the austenite grain boundary.

* * * * *